US011859822B2

(12) United States Patent
Fukuba et al.

(10) Patent No.: US 11,859,822 B2
(45) Date of Patent: Jan. 2, 2024

(54) BURNER ASSEMBLY, GAS TURBINE COMBUSTOR, AND GAS TURBINE

(71) Applicant: MITSUBISHI HEAVY INDUSTRIES, LTD., Tokyo (JP)

(72) Inventors: Shinichi Fukuba, Tokyo (JP); Satoshi Takiguchi, Tokyo (JP); Keisuke Miura, Tokyo (JP); Tomohiro Asai, Tokyo (JP); Kenji Miyamoto, Yokohama (JP); Tomo Kawakami, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/953,578

(22) Filed: Sep. 27, 2022

(65) Prior Publication Data

US 2023/0014495 A1 Jan. 19, 2023

Related U.S. Application Data

(63) Continuation of application No. PCT/JP2021/016118, filed on Apr. 21, 2021.

(30) Foreign Application Priority Data

Apr. 22, 2020 (JP) ..... 2020-076123

(51) Int. Cl.
*F23R 3/14* (2006.01)
*F23R 3/28* (2006.01)

(52) U.S. Cl.
CPC ..... *F23R 3/286* (2013.01); *F23R 3/14* (2013.01)

(58) Field of Classification Search
CPC .... F23R 3/14; F23R 3/286; F23R 3/28; F23R 3/283; F23R 3/12
See application file for complete search history.

(56) References Cited

U.S. PATENT DOCUMENTS 3,927,835 A * 12/1975 Gerrard ..... F23R 3/283 239/406
5,251,447 A * 10/1993 Joshi ..... F23R 3/14 431/185

(Continued)

FOREIGN PATENT DOCUMENTS

EP 1 826 485 8/2007
JP 2007-232234 9/2007

(Continued)

OTHER PUBLICATIONS

International Search Report dated Jun. 15, 2021 in International Application No. PCT/JP2021/016118, with English-language translation.

(Continued)

*Primary Examiner* — William H Rodriguez
(74) *Attorney, Agent, or Firm* — Wenderoth, Lind & Ponack, L.L.P.

(57) ABSTRACT

A burner assembly includes a plurality of burners for mixing fuel and air. Each of the plurality of burners includes: a fuel nozzle for injecting the fuel; a mixing passage supplied with the fuel and the air; and a support portion connecting a passage wall of the mixing passage and the fuel nozzle to support the fuel nozzle.

13 Claims, 14 Drawing Sheets

(56) References Cited

U.S. PATENT DOCUMENTS

| | | | | |
|---|---|---|---|---|
| 5,511,375 | A * | 4/1996 | Joshi | F23R 3/36 60/737 |
| 5,590,529 | A * | 1/1997 | Joshi | F23D 14/02 60/737 |
| 5,865,024 | A * | 2/1999 | Kress | F23R 3/36 60/737 |
| 6,026,645 | A * | 2/2000 | Stokes | F23R 3/286 60/737 |
| 6,415,594 | B1 * | 7/2002 | Durbin | F23R 3/286 60/748 |
| 2001/0023590 | A1 * | 9/2001 | Mandai | F23R 3/14 60/747 |
| 2006/0174625 | A1 * | 8/2006 | Ohri | F23R 3/14 60/737 |
| 2006/0236700 | A1 * | 10/2006 | Saitoh | F23R 3/14 60/737 |
| 2010/0077760 | A1 * | 4/2010 | Laster | F23R 3/286 60/742 |
| 2010/0218501 | A1 | 9/2010 | York et al. | |
| 2015/0292743 | A1 * | 10/2015 | Mook | F02C 7/18 29/889.22 |
| 2019/0086089 | A1 | 3/2019 | Takiguchi et al. | |
| 2019/0093570 | A1 | 3/2019 | Miyamoto et al. | |
| 2021/0088216 | A1 | 3/2021 | Tada et al. | |
| 2022/0003167 | A1 * | 1/2022 | Shershnyov | F23R 3/16 |
| 2023/0266012 | A1 * | 8/2023 | Kool | F23R 3/40 60/777 |

FOREIGN PATENT DOCUMENTS

| | | |
|---|---|---|
| JP | 2010-203758 | 9/2010 |
| JP | 2014-55689 | 3/2014 |
| JP | 2016-70557 | 5/2016 |
| JP | 2017-156033 | 9/2017 |
| JP | 2017-161087 | 9/2017 |
| JP | 2019-509460 | 4/2019 |
| JP | 2019-168198 | 10/2019 |
| WO | 2017/165876 | 9/2017 |

OTHER PUBLICATIONS

Translation of the International Preliminary Report on Patentability dated Nov. 3, 2022 in International Application No. PCT/JP2021/016118.

* cited by examiner

BURNER ASSEMBLY, GAS TURBINE COMBUSTOR, AND GAS TURBINE

The present application claims priority based on Japanese Patent Application No. 2020-076123 filed on Apr. 22, 2020, the entire content of which is incorporated herein by reference. The present application is a continuation application based on a PCT Patent Application No. PCT/JP2021/016118 whose priority is claimed on Japanese Patent Application No. 2020-076123. The content of the PCT Application is incorporated herein by reference.

TECHNICAL FIELD

The present disclosure relates to a burner assembly, a gas turbine combustor, and a gas turbine.

BACKGROUND ART

As a technique for achieving low NOx while maintaining flashback resistance for fuel with a high risk of flashback (e.g., hydrogen), a large number of independent short flames are formed by a burner assembly (cluster burner).

In this technique, by arranging multiple mixing passages for mixing fuel and air to reduce the scale of fuel mixing, high mixing performance can be achieved without actively using swirling flow for mixing fuel and air.

Patent Document 1 discloses a gas turbine combustor including a plurality of burners for mixing fuel and air, with a fuel nozzle disposed within a mixing passage for mixing fuel and air along the central axis of the mixing passage.

In the burner described in Patent Document 1, the fuel nozzle is configured to inject fuel along the central axis of the mixing passage, and the central axis of the fuel nozzle coincides with the central axis of the mixing passage, hence, it may be referred to as a coaxial burner. In such a coaxial burner, the fuel concentration near the wall surface of the mixing passage is less likely to be higher than that of a cross-flow burner in which fuel is injected in a direction intersecting the flow of air from the passage wall of the mixing passage, so that the risk of flashback (backfire) can be suppressed.

CITATION LIST

Patent Literature

Patent Document: JP2007-232234A

SUMMARY

Problems to be Solved

In the configuration described in Patent Document 1, since the plurality of fuel nozzles is supported by a header configured independently of the passage walls of the mixing passages, the air toward the mixing passages wraps around the header, passes through the nozzle portions, and flows into the mixing passages.

Therefore, the air is less likely to flow into a central mixing passage of the plurality of mixing passages than into an outer mixing passage, and the air flow rate is likely to vary between the mixing passages, so that the fuel concentration is likely to vary between the mixing passages. The variation of the fuel concentration between the mixing passages increases the risk of NOx and flashback.

In view of the above, an object of the present disclosure is to provide a burner assembly and a gas turbine combustor that can reduce NOx and suppress flashback.

Solution to the Problems

In order to achieve the above object, a burner assembly according to the present disclosure includes a plurality of burners for mixing fuel and air. Each of the plurality of burners includes: a fuel nozzle for injecting the fuel; a mixing passage supplied with the fuel and the air; and a support portion connecting a passage wall of the mixing passage and the fuel nozzle to support the fuel nozzle.

Advantageous Effects

The present disclosure provides a burner assembly and a gas turbine combustor that can reduce NOx and suppress flashback.

DETAILED DESCRIPTION

Figure 1:
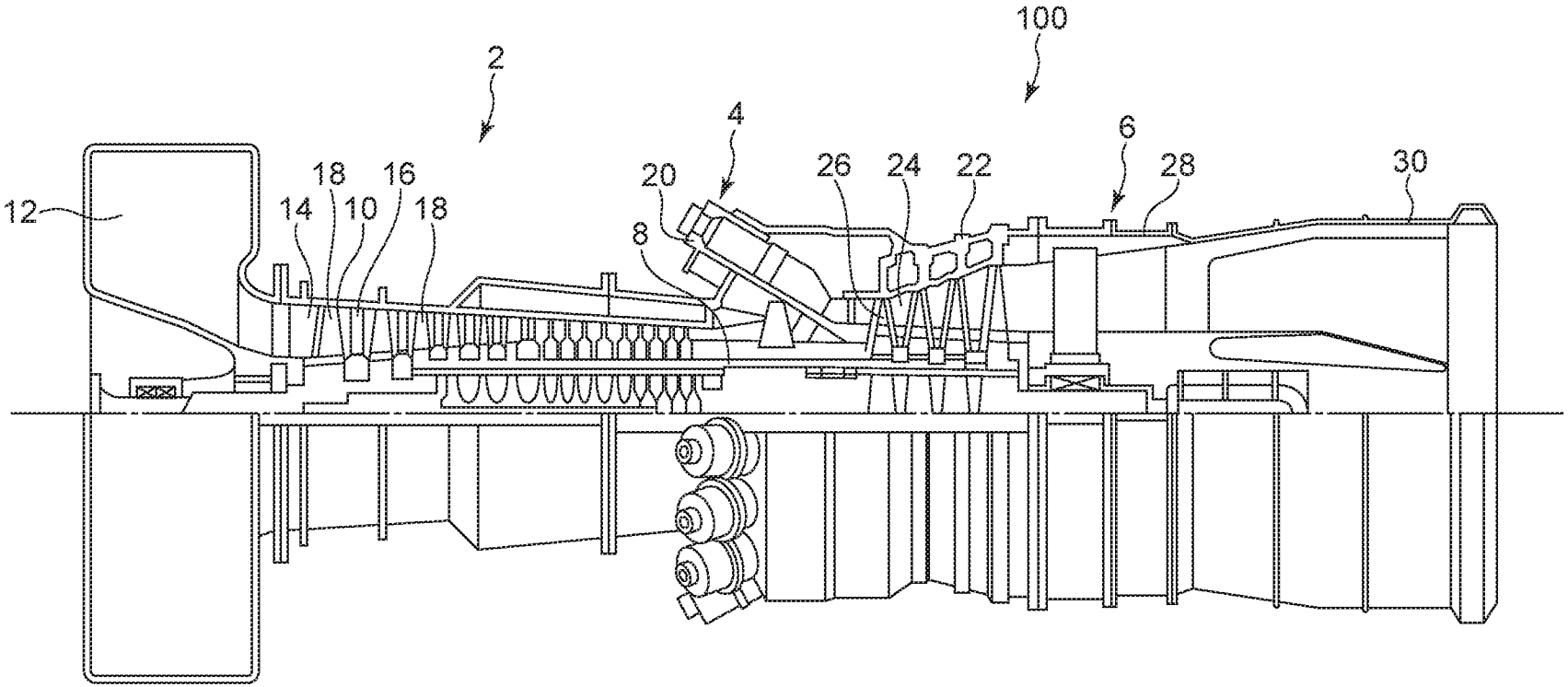
FIG. 1 is a schematic configuration diagram of a gas turbine 100 according to embodiment.

Embodiments of the present disclosure will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

FIG. 1 is a schematic configuration diagram of a gas turbine 100 according to an embodiment of the present disclosure. As shown in FIG. 1, the gas turbine 100 according to an embodiment includes a compressor 2 for compressing air (i.e., producing compressed air) that serves as an oxidant supplied to a combustor 4, a combustor 4 (gas turbine combustor) for producing combustion gas using the compressed air and fuel, and a turbine 6 configured to be driven by the combustion gas discharged from the combustor 4. In the case of the gas turbine 100 for power generation, a generator (not shown) is connected to the turbine 6, so that rotational energy of the turbine 6 generates electric power.

In the combustor 4 of the gas turbine 100, a gas mixture of fuel and air is combusted to produce the combustion gas. Examples of the fuel combusted in the combustor 4 include hydrogen, methane, light oil, heavy oil, jet fuel, natural gas, and gasified coal, and one or more of them may be used in any combination for combustion.

The compressor 2 includes a compressor casing 10, an air inlet 12 disposed on an inlet side of the compressor casing 10 for sucking in air, a rotor 8 disposed so as to penetrate both of the compressor casing 10 and a turbine casing 22, and a variety of blades disposed in the compressor casing 10. The variety of blades includes an inlet guide vane 14 disposed adjacent to the air inlet 12, a plurality of stator vanes 16 fixed to the compressor casing 10, and a plurality of rotor blades 18 implanted on the rotor 8 so as to be arranged alternately with the stator vanes 16. In the compressor 2, the air sucked in from the air inlet 12 flows through the plurality of stator vanes 16 and the plurality of rotor blades 18 to be compressed into compressed air having a high temperature and a high pressure. The compressed air having a high temperature and a high pressure is sent to the combustor 4 of a latter stage from the compressor 2.

A plurality of combustors 4 are arranged at intervals in the circumferential direction around the rotor 8. The combustor 4 is supplied with fuel and the compressed air produced in the compressor 2, and combusts the fuel to produce combustion gas that serves as a working fluid of the turbine 6. The combustion gas is sent to the turbine 6 at a latter stage from the combustor 4.

The turbine 6 includes a turbine casing 22 and a variety of blades disposed in the turbine casing 22. The variety of blades includes a plurality of stator vanes 24 fixed to the turbine casing 22 and a plurality of rotor blades 26 implanted on the rotor 8 so as to be arranged alternately with the stator vanes 24. In the turbine 6, the rotor 8 is driven to rotate as the combustion gas passes through the plurality of stator vanes 24 and the plurality of rotor blades 26. In this way, the generator (not shown) connected to the rotor 8 is driven.

Figure 2:
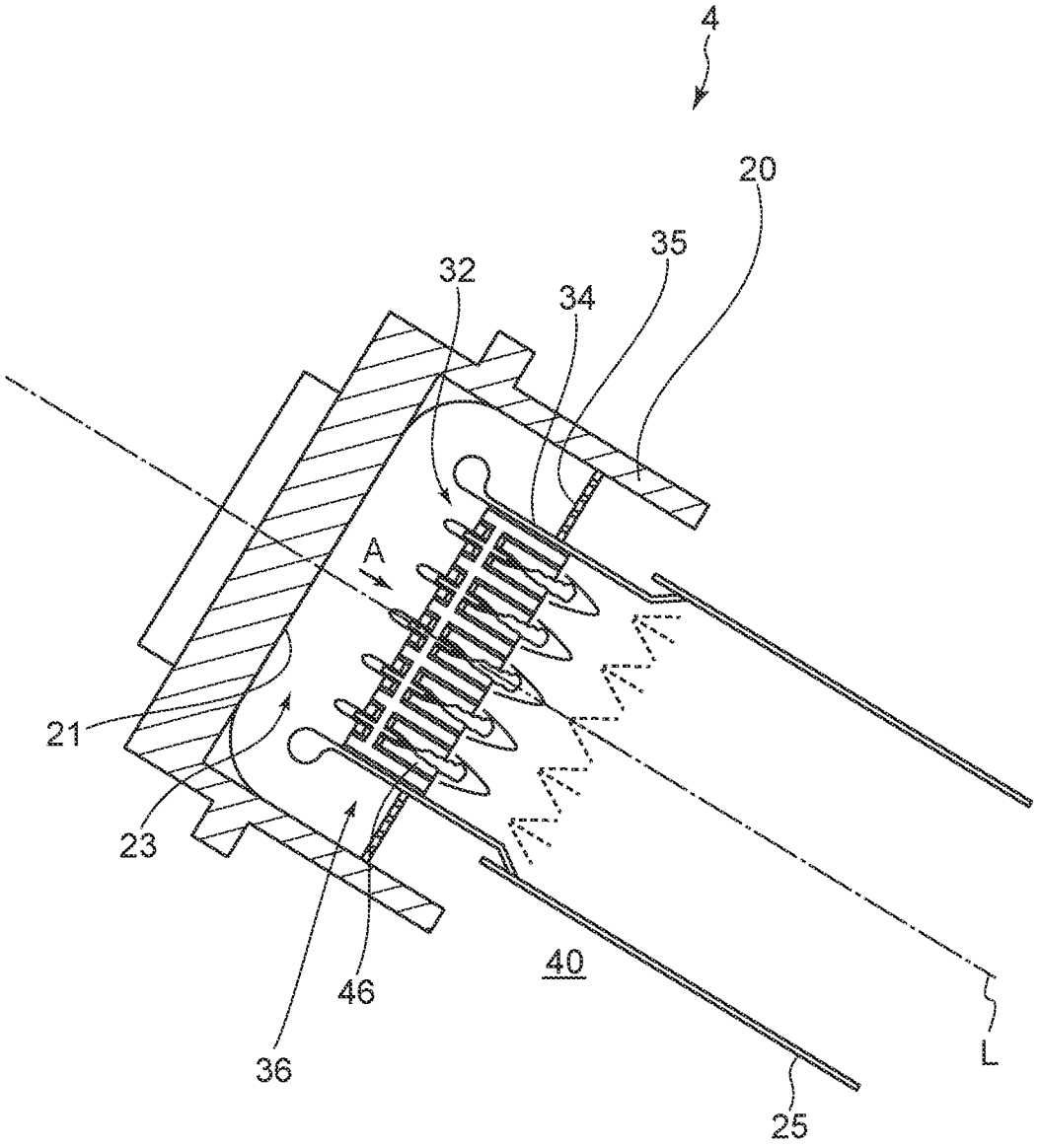
FIG. 2 is a cross-sectional view of the vicinity of a combustor 4.

Further, an exhaust chamber 30 is connected to the downstream side of the turbine casing 22 via an exhaust casing 28. The combustion gas having driven the turbine 6 is discharged outside through the exhaust casing 28 and the exhaust chamber 30, FIG. 2 is a cross-sectional view of the vicinity of the combustor 4. The combustor 4 includes a burner assembly 32, a bottomed cylindrical casing 20 for accommodating the burner assembly 32, and a combustion liner 25 forming a space in which a flame is formed downstream of the burner assembly 32. In FIG. 2, the dash-dotted line indicates a central axis L common to the casing 20, the burner assembly 32, and the combustion liner 25, The burner assembly 32 is disposed inside the casing 20 of the combustor 4.

In the illustrated exemplary embodiment, the burner assembly 32 is held inside a cylindrical member 34 disposed inside the casing 20. The cylindrical member 34 is supported by the casing 20 via a plurality of support portions 35 arranged at intervals around the central axis L. An air passage 36 for the compressed air flowing from a casing 40 is formed between the casing 20 and the outer peripheral surface of the cylindrical member 34 (between the casing 20 and the outer peripheral surface of the burner assembly 32).

The compressed air flowing from the casing 40 into the air passage 36 passes through an axial gap 23 between the burner assembly 32 and a bottom surface 21 of the casing 20 and enters a plurality of mixing passages 46, which will described later, of the burner assembly 32 together with fuel. The fuel and the air are mixed in the burner assembly 32, and the mixture is ignited by an ignition device (not shown) to form a flame in the combustion liner 25 and produce the combustion gas.

Figure 3:
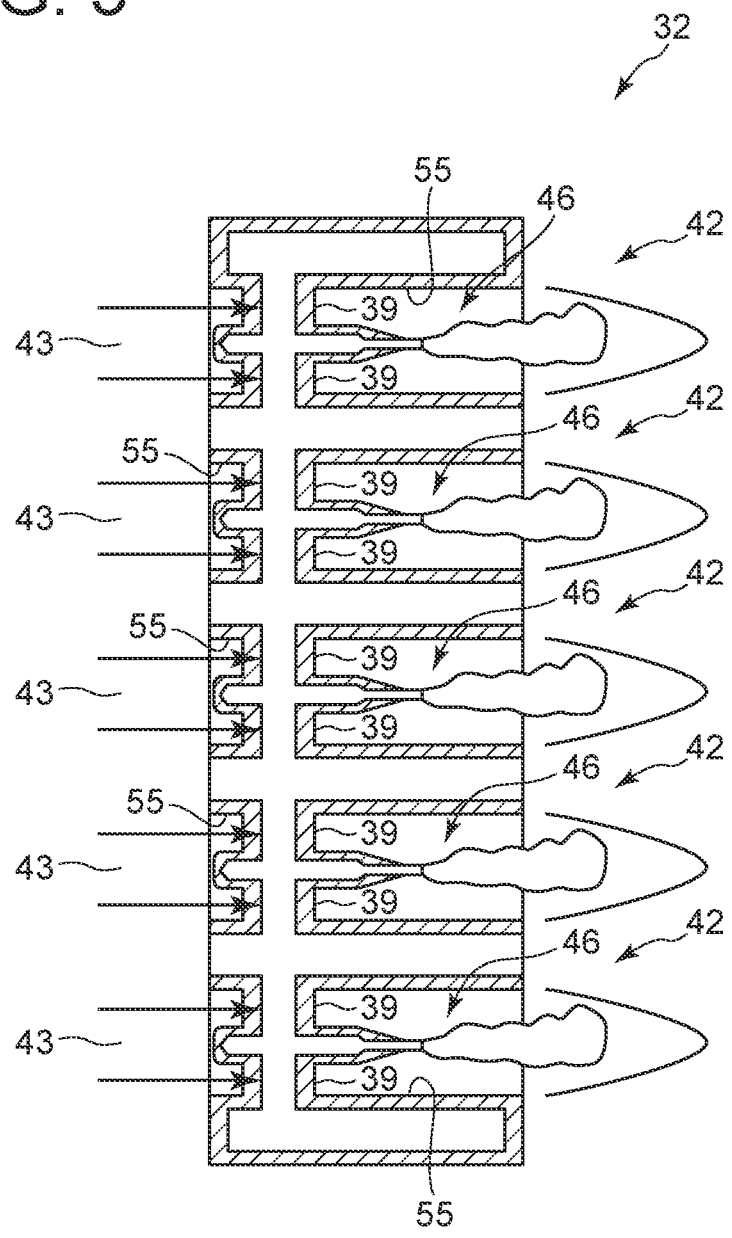
FIG. 3 is a schematic cross-sectional view of a burner assembly 32 according to an embodiment, taken along the central axis L.

FIG. 3 is a schematic cross-sectional view of the burner assembly 32 according to an embodiment, taken along the central axis L.

As shown in FIG. 3, the burner assembly 32 includes a plurality of burners 42 for mixing fuel and air.

Each of the plurality of burners 42 includes a fuel nozzle 43 for injecting fuel, a mixing passage 46 supplied with the fuel and air, and a plurality of support portions 39 connecting a passage wall 55 of the mixing passage 46 and the fuel nozzle 43 to support the fuel nozzle 43. Since the plurality of burners 42 have basically the same configuration except for the portion forming the outer peripheral surface of the burner assembly 32, the configuration common to the burners 42 will be described below FIG. 4 is a cross-sectional view of an example of a detailed configuration of the burner 42.

Figure 4:
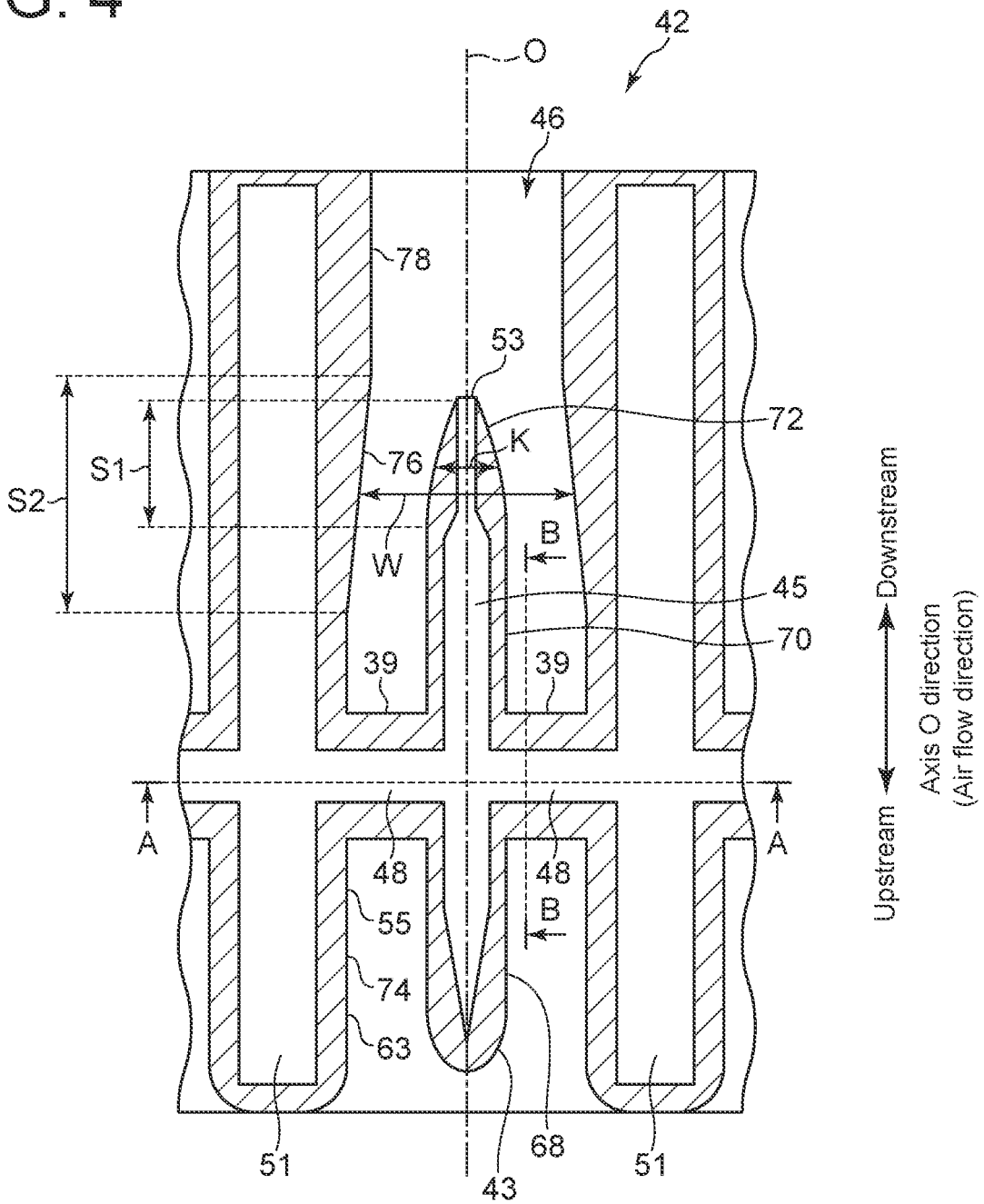
FIG. 4 is a cross-sectional view of an example of a detailed configuration of a burner 42.

As shown in FIG. 4, the fuel nozzle 43 is formed in a tubular shape and extends along the central axis O of the mixing passage 46. A fuel passage 45 is formed on the central axis O inside the fuel nozzle 43, and a fuel injection hole 53 connected to the fuel passage 45 is formed at the tip of the fuel nozzle 43. The fuel nozzle 43 includes a constant outer diameter portion 70 and a tapered portion 72. The outer diameter K of the constant outer diameter portion 70 is constant in the direction along the central axis O (hereinafter, simply referred to as "axis O direction"). The outer diameter K of the tapered portion 72 gradually decreases downstream in the air flow direction along the central axis O. Hereinafter, upstream of the air flow direction along the central axis O is simply referred to as "upstream", and downstream of the air flow direction along the central axis O is simply referred to as "downstream".

The mixing passage 46 is formed in a tubular shape and extends along the central axis O. Inside the passage wall 55 of the mixing passage 46, a fuel chamber 51 for holding fuel to be supplied to the fuel nozzle 43 is formed. The passage wall 55 of the mixing passage 46 includes constant passage width portions 74, 78 and a contraction portion 76. The passage width W of each of the constant passage width portion 74 and the constant passage width portion 78 is constant in the axis O direction. The passage width W of the contraction portion 76 gradually decreases downstream. In the illustrated exemplary embodiment, the constant passage width portion 74, the contraction portion 76, and the constant passage width portion 78 are disposed in order from upstream.

A range S1 where the tapered portion 72 is disposed and a range S2 where the contraction portion 76 is disposed at least partially overlap in the axis O direction. In other words, the existence range S1 of the tapered portion 72 is at least partially within the existence range S2 of the contraction portion 76. In the illustrated exemplary embodiment, the entire range S1 is within the range 52, Inside the support portion 39, a fuel passage 48 for supplying fuel to the fuel nozzle 43 is formed. One end of the fuel passage 48 is connected to the fuel passage 45 of the fuel nozzle 43, and the other end of the fuel passage 48 is connected to the fuel chamber 51.

Figure 5:
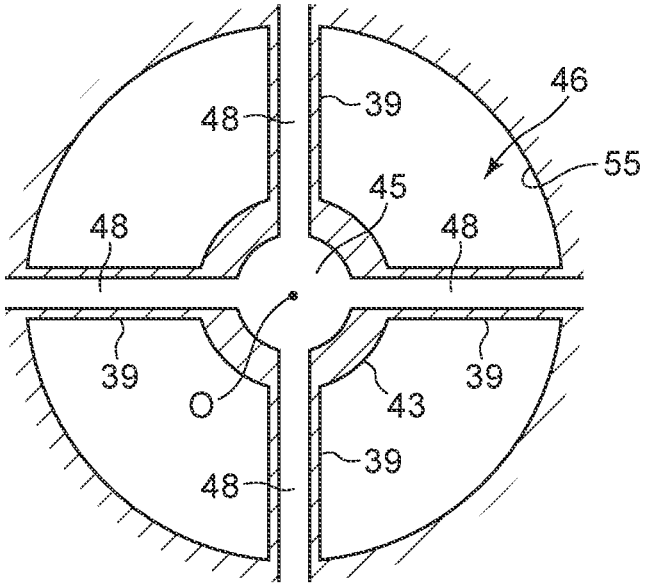
FIG. 5 is a diagram showing an example of cross-section A-A (cross-section perpendicular to the central axis O) in FIG. 4.

FIG. 5 is a diagram showing an example of cross-section A-A (cross-section perpendicular to the central axis O) in FIG. 4.

As shown in FIG. 5, the plurality of support portions 39 are arranged around the fuel nozzle 43 at intervals, and each support portion 39 extends along the radial direction of the fuel nozzle 43 (hereinafter, simply referred to as "radial direction"). In the illustrated exemplary embodiment, the plurality of support portions 39 includes four support portions 39.

Figure 6:
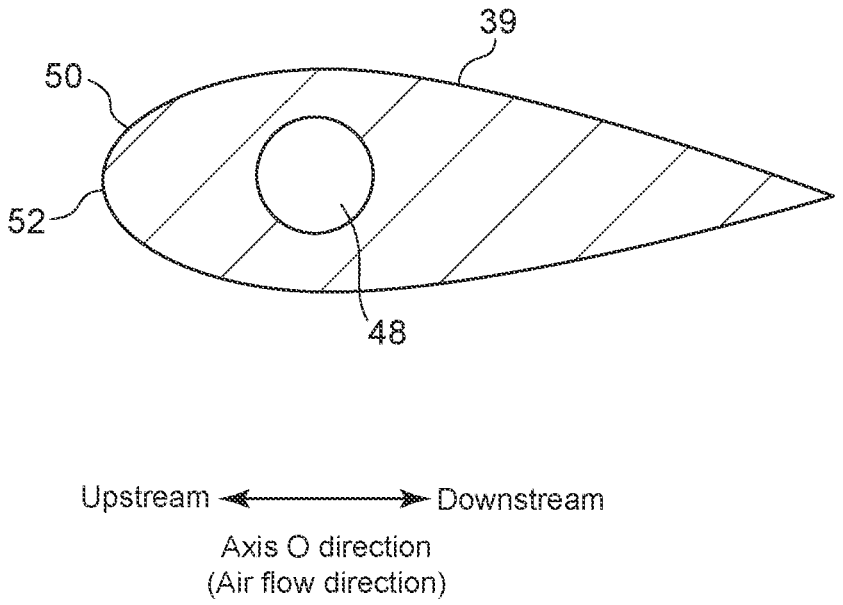
FIG. 6 is a diagram showing an example of cross-section B-B (cross-section perpendicular to the radial direction) in FIG. 4.

FIG. 6 is a diagram showing an example of cross-section B-B (cross-section perpendicular to the radial direction) in FIG. 4.

As shown in FIG. 6, an upstream surface 50 of the support portion 39 includes a convex curved surface 52 that is smoothly curved. In the illustrated exemplary embodiment, the support portion 39 is streamlined in a cross-section perpendicular to the radial direction of the support portion 39. Further, the cross-section of the fuel passage 48 formed inside the support portion 39 has a circular shape. In another embodiment, the support portion 39 may be circular, for example, in a cross-section perpendicular to the radial direction of the support portion 39.

According to the above configuration, as shown in FIG. 4, etc., in each burner 42, the fuel nozzle 43 is supported by the support portion 39 connected to the wall surface 63 of the passage wall 55 of the mixing passage 46, so it is not necessary to provide a large header, as described in Patent Document 1, which is configured independently of the passage wall 55 of the mixing passage 46 on the upstream side of the mixing passage 46. Accordingly, the variation of the air flow rate between the mixing passages due to the header can be eliminated, and the variation of the fuel concentration between the mixing passages 46 can be reduced. Thus, it is possible to reduce NOx and suppress flashback.

Additionally, since the range S1 where the tapered portion 72 is disposed and the range S2 where the contraction portion 76 is disposed at least partially overlap in the axis O direction, the change in the passage cross-sectional area of the mixing passage 46 in the axis O direction due to the tapered portion 72 of the fuel nozzle 43 can be suppressed. As a result, it is possible to suppress the decrease in the air flow velocity in the mixing passage 46 due to the tapered portion 72, and it is possible to bring the air flow velocity in the mixing passage 46 close to constant. Thus, it is possible to suppress flashback effectively.

Additionally, since the upstream surface 50 of the support portion 39 in the air flow direction includes the convex curved surface 52, it is possible to suppress the increase in the flow resistance of the support portion 39 and suppress the change in the air flow velocity in the mixing passage 46. Thus, it is possible to suppress flashback effectively.

Figure 7:
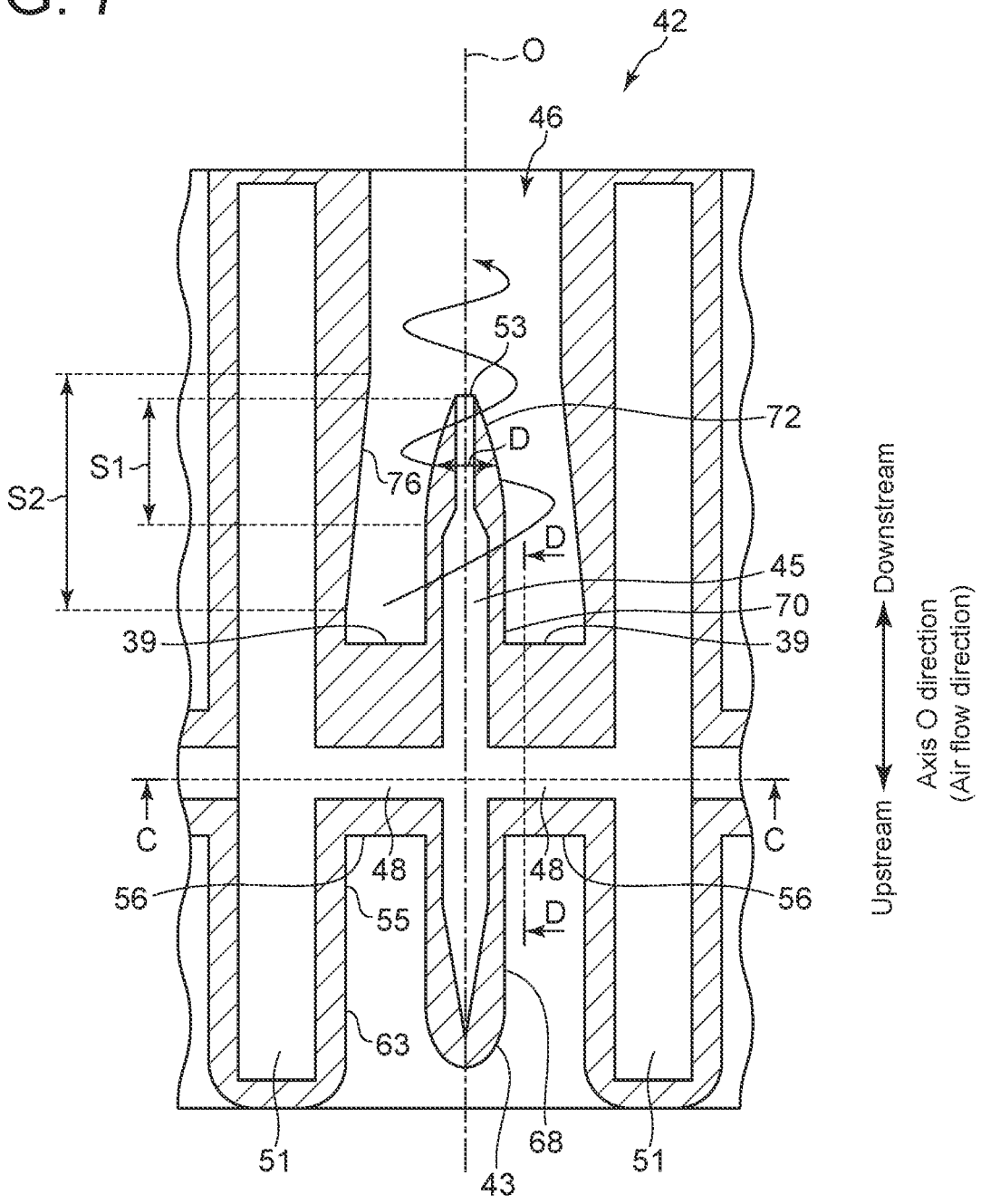
FIG. 7 is a cross-sectional view of another example of a detailed configuration of the burner 42.
Figure 8:
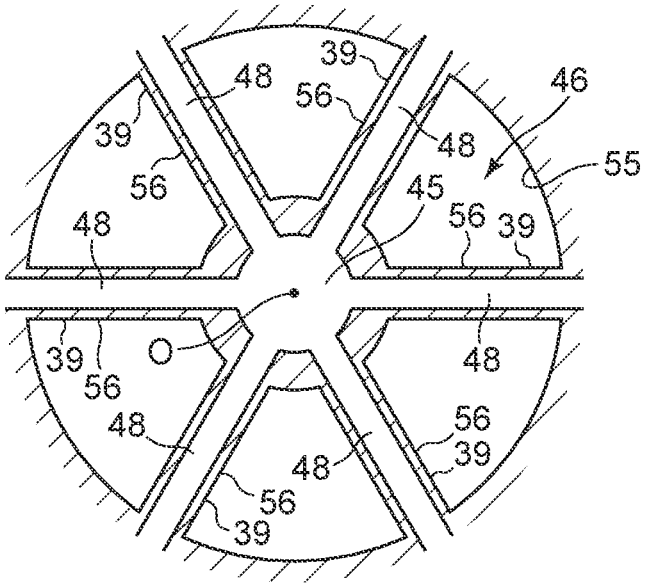
FIG. 8 is a diagram showing an example of cross-section C-C (cross-section perpendicular to the central axis O) in FIG. 7.
Figure 9:
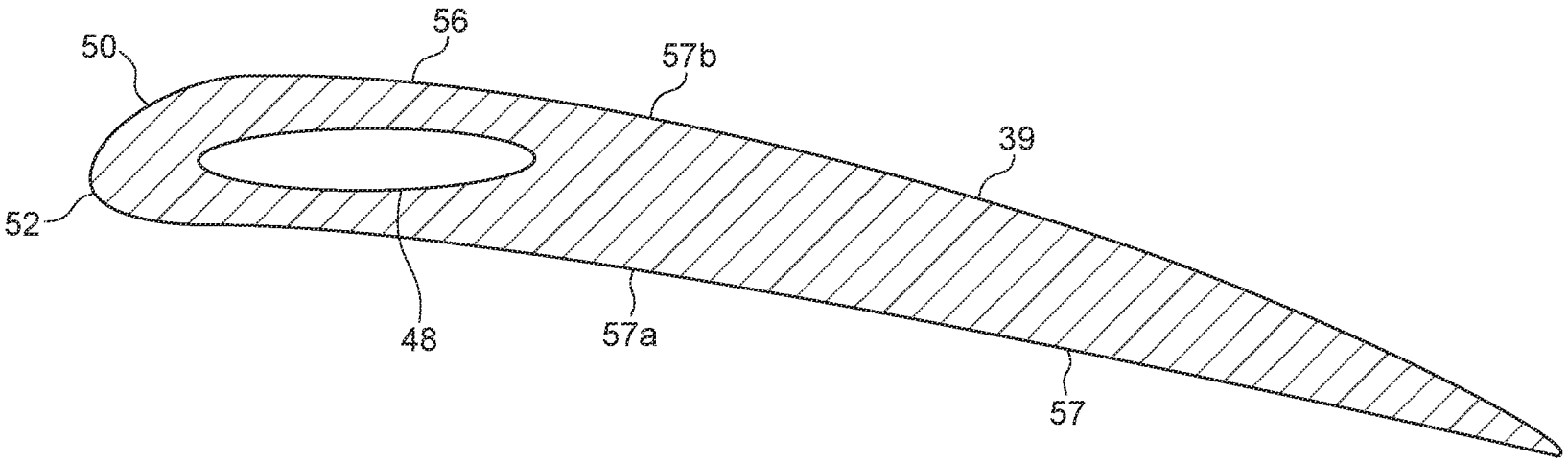
FIG. 9 is a diagram showing an example of cross-section D-D (cross-section perpendicular to the radial direction) in FIG. 7.

FIG. 7 is a cross-sectional view of another example of a detailed configuration of the burner 42. FIG. 8 is a diagram showing an example of cross-section C-C (cross-section perpendicular to the central axis O) in FIG. 7. FIG. 9 is a diagram showing an example of cross-section D-D (cross-section perpendicular to the radial direction) in FIG. 7.

In the burner 42 shown in FIGS. 7 to 9, unless otherwise noted, reference signs common to the components of the burner 42 shown in FIG. 4, etc., indicate the same components as those of the burner 42 shown in FIG. 4, etc., and the explanation is omitted.

The burner 42 shown in FIGS. 7 to 9 is different from the burner 42 shown in FIGS. 4 to 6 in the number of the support portions 39 and the shape of the support portions 39.

The burner 42 shown in FIGS. 7 to 9 includes six support portions 39 as the plurality of support portions 39 disposed around the fuel nozzle 43 at intervals. Each support portion 39 is a swirl vane 56 configured to form an air flow in a common swirling direction. An outer surface 57 of the swirl vane 56 includes an upper surface 57*a* and a lower surface 57*b*. The cross-section of the fuel passage 48 formed inside the support portion 39 has an oval shape.

With this configuration, the plurality of swirl vanes 56 function as swirlers and can impart swirl to the air passing through the mixing passage 46. As a result, mixing of air and fuel in the mixing passage 46 is promoted, and further reduction in NOx can be expected.

Figure 10:
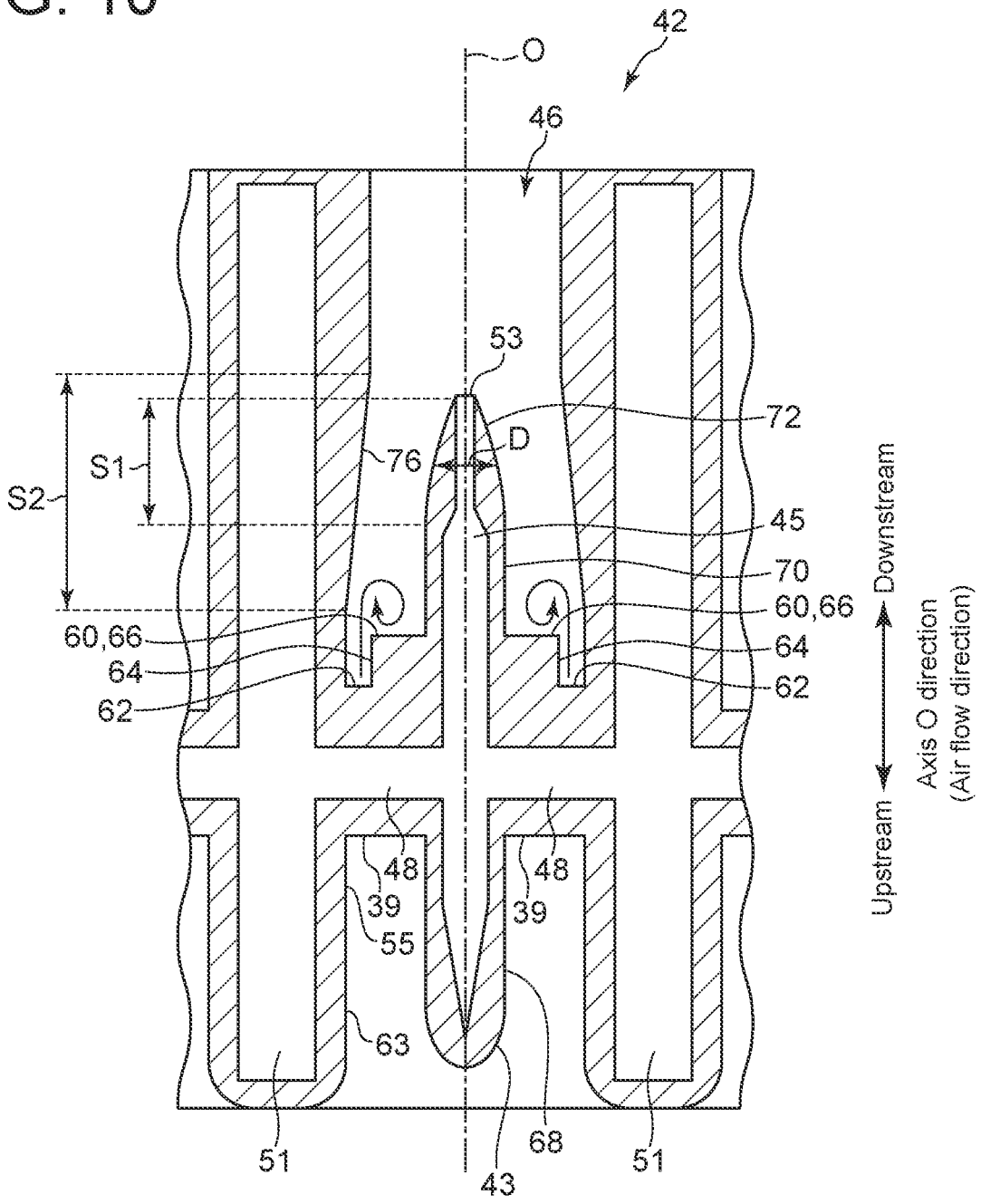
FIG. 10 is a cross-sectional view of another example of a detailed configuration of the burner 42.
Figure 11:
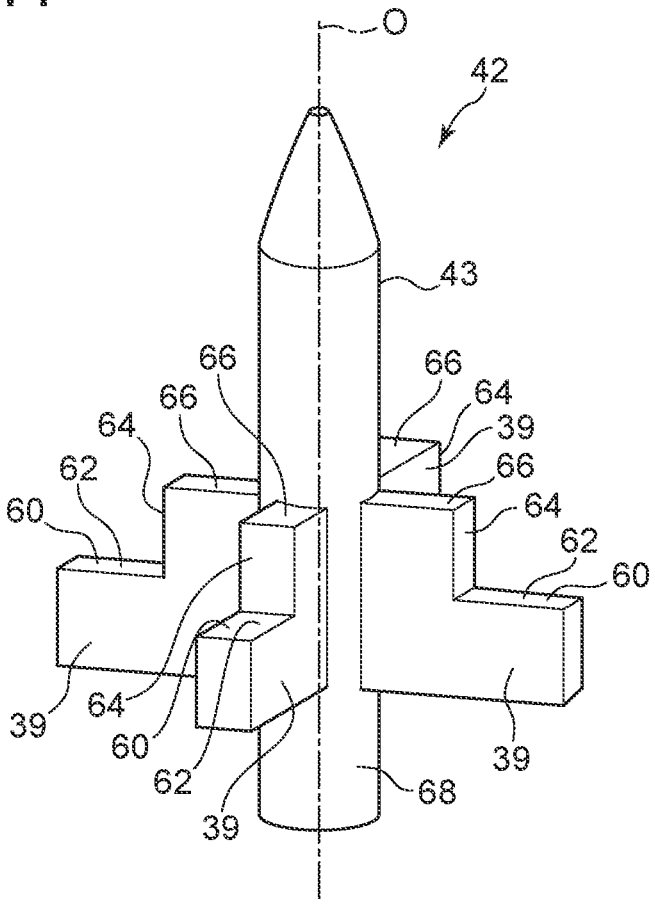
FIG. 11 is a schematic perspective view of a nozzle 43 and support portions 39 of the burner 42 shown in FIG. 10.

FIG. 10 is a cross-sectional view of another example of a detailed configuration of the burner 42. FIG. 11 is a schematic perspective view of the nozzle 43 and the support portions 39 of the burner 42 shown in FIG. 10, In the burner 42 shown in FIG. 10, unless otherwise noted, reference signs common to the components of the burner 42 shown in FIGS. 4 to 6 indicate the same components as those of the burner 42 shown in FIGS. 4 to 6 and the explanation is omitted.

The burner 42 shown in FIG. 10 is different from the burner 42 shown in FIGS. 4 to 6 in the shape of the support portions 39.

In the burner 42 shown in FIGS. 10 and 11, a downstream surface 60 of the support portion 39 includes a first surface 62, a stepped surface 64, and a second surface 66. The first surface 62 is located upstream of the second surface 66 in the axis O direction. The first surface 62 is formed so as to intersect the axis O direction (perpendicular in the illustrated embodiment), and connects the wall surface 63 of the mixing passage 46 to the stepped surface 64. The stepped surface 64 is formed so as to intersect the radial direction (perpendicular in the illustrated embodiment), and connects the first surface 62 to the second surface 66. The second surface 66 is formed so as to intersect the axis O direction (perpendicular in the illustrated embodiment), and connects the stepped surface 64 to the outer peripheral surface 68 of the nozzle 43, In the illustrated embodiment, the support portion 39 is rectangular or substantially rectangular in a cross-section perpendicular to the radial direction.

With this configuration, as shown in FIG. 10, since a longitudinal vortex is formed downstream of the stepped surface 64 in the mixing passage 46, mixing of air and fuel is promoted by the longitudinal vortex, and further reduction in NOx can be expected.

Figure 12:
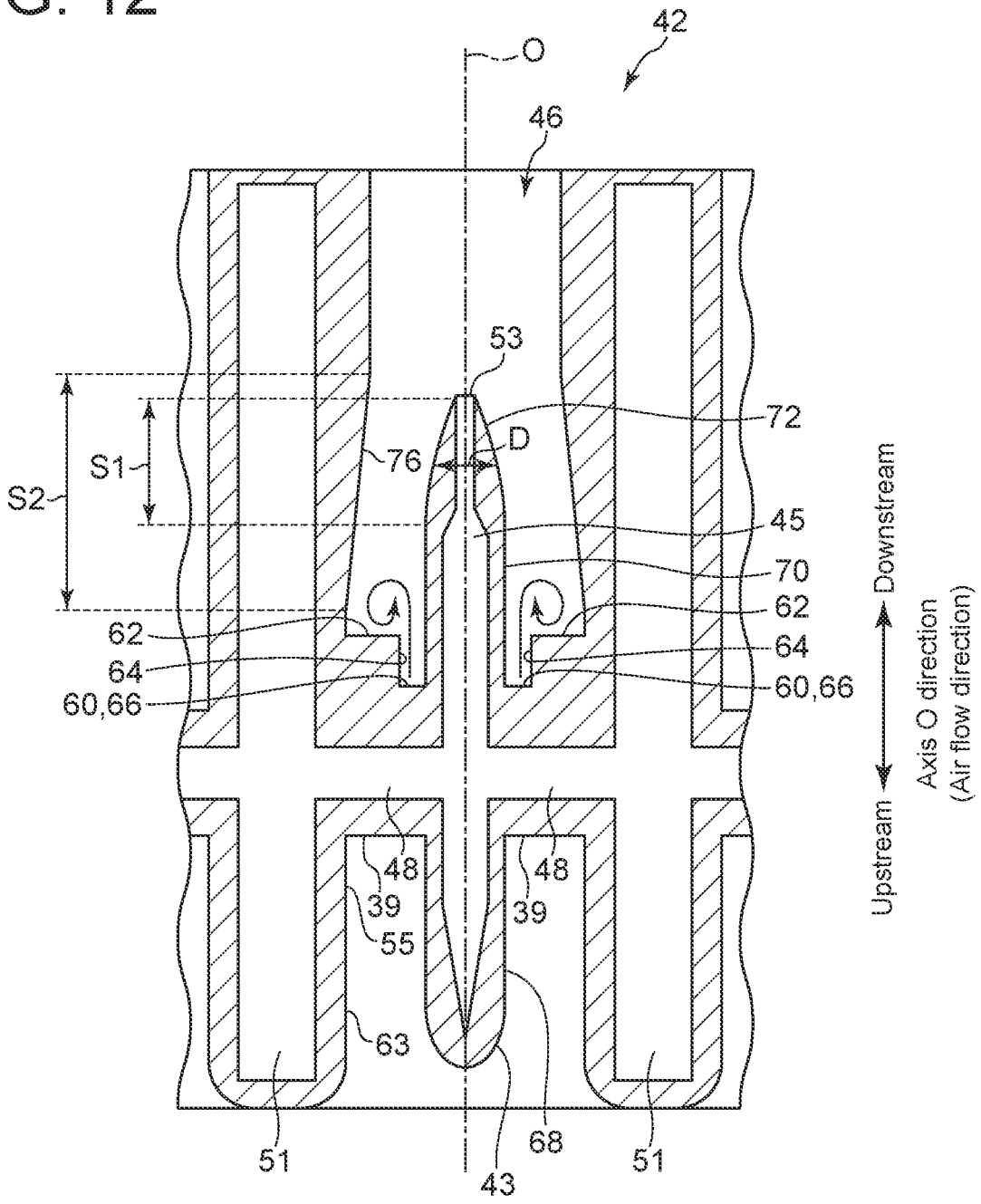
FIG. 12 is a cross-sectional view of another example of a detailed configuration of the burner 42.

In the configuration shown in FIG. 10, the first surface 62 is located upstream of the second surface 66, but for example as shown in FIG. 12, the first surface 62 may be located downstream of the second surface 66. With this configuration, similarly, since a longitudinal vortex is formed downstream of the stepped surface 64 in the mixing passage 46, mixing of air and fuel is promoted by the longitudinal vortex, and further reduction in NOx can be expected.

Figure 13:
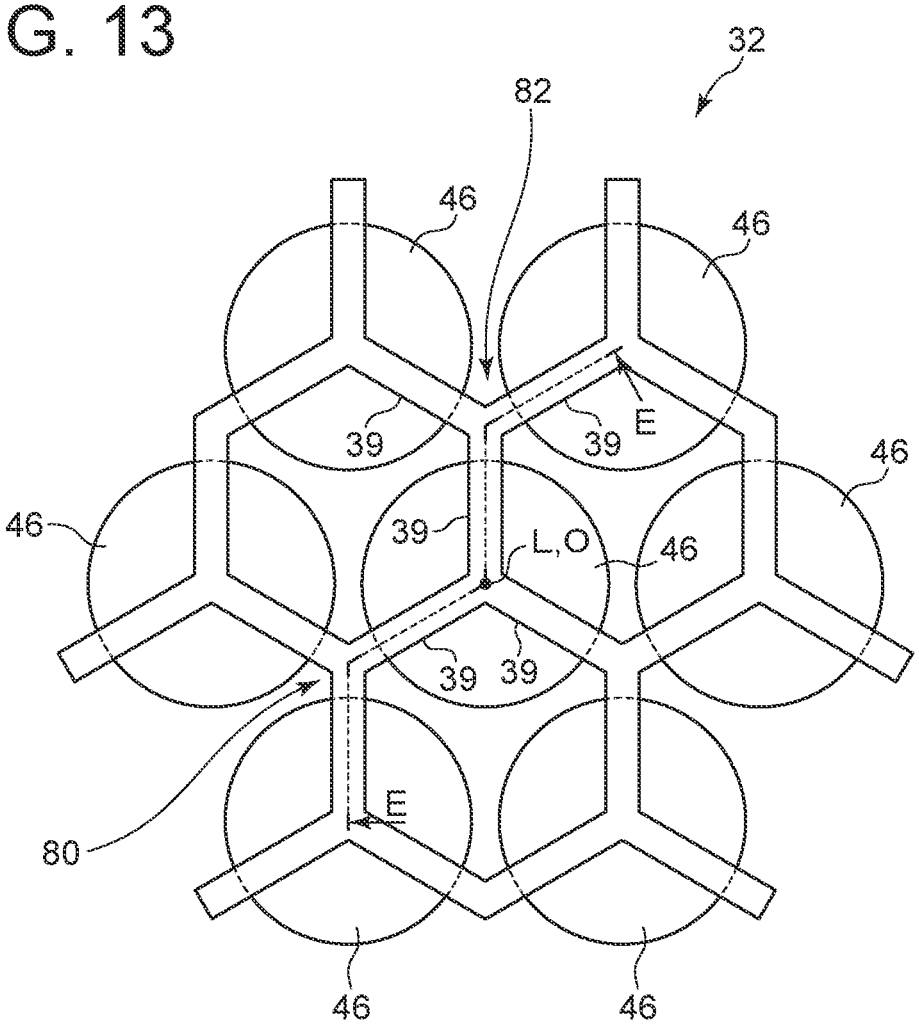
FIG. 13 is a schematic diagram partially showing another configuration example of the burner assembly 32, where a portion of the burner assembly 32 is viewed from upstream in the axis L direction.
Figure 14:
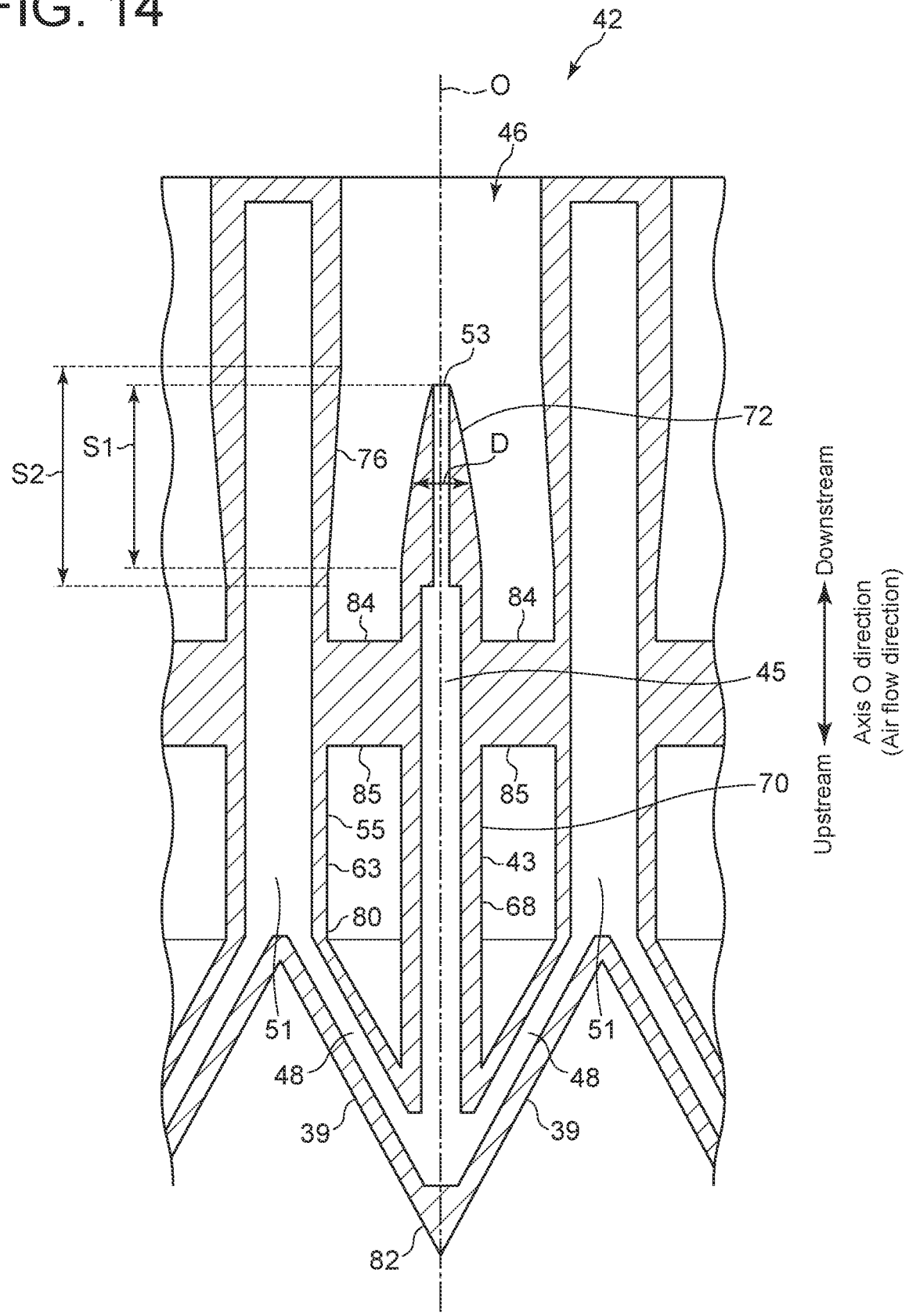
FIG. 14 is a schematic cross-sectional view partially showing cross-section E-E in FIG. 13.

FIG. 13 is a schematic diagram partially showing another configuration example of the burner assembly 32, where a portion of the burner assembly 32 is viewed from upstream in the axis L direction. FIG. 14 is a schematic cross-sectional view partially showing cross-section E-E in FIG. 13.

In the burner assembly 32 shown in FIG. 13, unless otherwise noted, reference signs common to the components of the burner assembly 32 shown in FIGS. 3 to 6 indicate the same components as those of the burner assembly 32 shown in FIGS. 3 to 6 and the explanation is omitted.

The configuration of the burner assembly 32 shown in FIGS. 13 and 14 is different from that shown in FIG. 4, etc., in the position and shape of the support portions 39 of the burner 42.

In the configuration shown in FIGS. 13 and 14, each of the support portions 39 supporting the fuel nozzle 43 is disposed upstream of the mixing passage 46. One end of the support portion 39 is connected to an upstream end portion 80, which is the upstream end portion of the passage wall 55 of the mixing passage 46, and the other end of the support portion 39 is connected to an upstream end portion 82, which is the upstream end portion of the fuel nozzle 43. Further, the upstream end portion 82 of the fuel nozzle 43 is located outside the mixing passage 46, and the support portion 39 extends away from the fuel injection hole 53 of the fuel nozzle 43 in the axis O direction as it comes close to the fuel nozzle 43.

Each support portion 39 may be circular, or may be streamlined as shown in FIG. 6, for example, in a cross-section perpendicular to the radial direction of the support portion 39. Each support portion 39 may be a swirl vane 56 configured to form an air flow in a common swirling direction, as shown in FIG. 9.

Further, in the configuration shown in FIG. 14, in addition to the support portions 39 inside which the fuel passage 48 is formed, support portions 84 inside which no fuel passage is formed are provided in the mixing passage 46. The support portions 84 are disposed downstream of the support portions 39 and inside the mixing passage 46 at intervals around the fuel nozzle 43. Each support portion 84 connects the wall surface 63 of the passage wall 55 of the mixing passage 46 and the fuel nozzle 43 to support the fuel nozzle 43.

The support portion 84 may be circular or streamlined, for example, in a cross-section perpendicular to the radial direction of the support portion 84. Each support portion 84 may be a swirl vane 85 configured to form an air flow in a common swirling direction. The plurality of swirl vanes 85, which function as swirlers, can impart swirl to the air passing through the mixing passage 46. As a result, mixing of air and fuel in the mixing passage 46 is promoted, and further reduction in NOx can be expected.

In the configuration shown in FIGS. 13 and 14, similarly, in each burner 42, the fuel nozzle 43 is supported by the support portion 39 connected to the passage wall 55 of the mixing passage 46, so it is not necessary to provide a large header, as described in Patent Document 1, which is configured independently of the passage wall 55 of the mixing passage 46 on the upstream side of the mixing passage 46. Accordingly, the variation of the air flow rate between the mixing passages due to the header can be eliminated, and the variation of the fuel concentration between the mixing passages 46 can be reduced. Thus, it is possible to reduce NOx and suppress flashback.

When the support portion 39 having the fuel passage 48 is disposed in the mixing passage 46 as shown in FIG. 4, etc., the passage area of the mixing passage 46 decreases, and the pressure loss increases. In this regard, in the configuration shown in FIGS. 13 and 14, since the support portion 39 having the fuel passage 48 is disposed outside the mixing passage 46, it is possible to suppress the decrease in the passage area of the mixing passage 46, and suppress the increase in the pressure loss. Further, even when the support portion 84 having no fuel passage is disposed in the mixing passage 46, as compared with the case where the support portion 39 having the fuel passage is disposed in the mixing passage 46, the decrease in the passage area of the mixing passage 46 can be suppressed, so that the stiffness of the burner 42 can be ensured while suppressing the increase in pressure loss.

The present disclosure is not limited to the embodiments described above, but includes modifications to the embodiments described above, and embodiments composed of combinations of those embodiments.

For example, in the above-described embodiments, the passage wall 55 of the mixing passage 46 includes the contraction portion 76, but the passage wall 55 of the mixing passage 46 may not include the contraction portion 76. For example, the passage width of the mixing passage 46 may be constant in the axis O direction from the inlet to the outlet of the mixing passage 46.

Further, in the above-described embodiment with the tapered portion 72, the existence range S1 of the tapered portion 72 is within the existence range S2 of the contraction portion 76, but a part of the existence range S1 of the tapered portion 72 may be outside the existence range S2 of the contraction portion 76.

Further, the burners 42 included in the burner assembly 32 may have the same configuration or different configurations from each other. For example, each of the burners 42 included in the burner assembly 32 may be the burner 42 described with reference to FIG. 4, etc., or each of the burners 42 included in the burner assembly 32 may be the burner 42 described with reference to FIG. 7, etc. Further, each of the burners 42 included in the burner assembly 32 may be the burner 42 described with reference to FIG. 10, or each of the burners 42 included in the burner assembly 32 may be the burner 42 described with reference to FIG. 12, etc., or each of the burners 42 included in the burner assembly 32 may be the burner 42 described with reference to FIG. 14, etc. Further, the burner assembly 32 may include the burners 42 with different configurations from each other in combination, The contents described in the above embodiments would be understood as follows, for instance.

(1) A burner assembly according to the present disclosure is a burner assembly (e.g., the above-described burner assembly 32) including a plurality of burners (e.g., the above-described burners 42) for mixing fuel and air. Each of the plurality of burners includes: a fuel nozzle (e.g., the above-described fuel nozzle 43) for injecting the fuel; a mixing passage (e.g., the above-described mixing passage 46) supplied with the fuel and the air; and a support portion (e.g., the above-described support portion 39) connecting a passage wall (e.g., the above-described passage wall 55) of the mixing passage and the fuel nozzle to support the fuel nozzle.

With the burner assembly described in (1), in each burner, the fuel nozzle is supported by the support portion connected to the passage wall of the mixing passage, so it is not necessary to provide a large header, as described in Patent Document 1, which is disposed independently of the passage wall of the mixing passage on the upstream side of the mixing passage. Accordingly, the variation of the air flow rate between the mixing passages due to the header can be eliminated, and the variation of the fuel concentration between the mixing passages can be reduced. Thus, it is possible to reduce NOx and suppress flashback.

(2) In some embodiments, in the burner assembly described in (1), the fuel nozzle includes a tapered portion (e.g., the above-described tapered portion 72) whose outer diameter decreases downstream in a flow direction of the air. The mixing passage includes a contraction portion (e.g., the above-described contraction portion 76) whose passage width decreases downstream in the flow direction of the air. A range (e.g., the above-described range S1) where the tapered portion is disposed and a range (e.g., the above-described range S2) where the contraction portion is disposed at least partially overlap in an axial direction of the mixing passage.

With the burner assembly described in (2), it is possible to suppress the change in the passage cross-sectional area of the mixing passage in the axial direction due to the tapered portion of the fuel nozzle. As a result, it is possible to suppress the decrease in the air flow velocity in the mixing passage due to the tapered portion, and it is possible to bring the air flow velocity in the mixing passage close to constant. Thus, it is possible to suppress flashback effectively.

(3) In some embodiments, in the burner assembly described in (1) or (2), a fuel passage (e.g., the above-described fuel passage 48) for supplying the fuel to the fuel nozzle is formed inside the support portion.

With the burner assembly described in (3), as compared with the case where the fuel supply line is provided separately from the support portion, by providing the fuel supply line inside the support portion, the configuration of the burner assembly can be simplified.

(4) In some embodiments, in the burner assembly described in (3), the support portion is formed inside the mixing passage.

With the burner assembly described in (4), it is possible to effectively reduce the variation of the fuel concentration between the mixing passages.

(5) In some embodiments, in the burner assembly described in (3), the support portion is disposed upstream of the mixing passage in a flow direction of the air (e.g., the air flow direction along the axis O described above)

With the burner assembly described in (5), since the support portion having the fuel passage is disposed outside the mixing passage, as compared with the case where the support portion having the fuel passage is disposed in the mixing passage, it is possible to suppress the decrease in the passage area of the mixing passage, and suppress the increase in the pressure loss.

(6) In some embodiments, in the burner assembly described in (5), an upstream end portion (e.g., the above-described upstream end portion 48) of the fuel nozzle in the flow direction of the air is located outside the mixing passage. The support portion extends away from a fuel injection hole (e.g., the above-described fuel injection hole 53) of the fuel nozzle in an axial direction of the mixing passage as the support portion comes close to the fuel nozzle.

With the burner assembly described in (6), since the support portion can be provided outside the mixing passage while ensuring the area of the inlet of the mixing passage, it is possible to effectively suppress the increase in the pressure loss of the mixing passage.

(7) In some embodiments, in the burner assembly described in any one of (1) to (6), an upstream surface of the support portion in a flow direction of the air includes a convex curved surface (e.g., the above-described convex curved surface 52).

With the burner assembly described in (7), it is possible to suppress the increase in the flow resistance of the support portion and suppress the change in the air flow velocity in the mixing passage. Thus, it is possible to suppress flashback effectively.

(8) In some embodiments, in the burner assembly described in any one of (1) to (7), a downstream surface of the support portion in a flow direction of the air includes a stepped surface (e.g., the above-described stepped surface 64).

With the burner assembly described in (8), since a longitudinal vortex is formed downstream of the stepped surface in the mixing passage, mixing of air and fuel is promoted by the longitudinal vortex, and further reduction in NOx can be expected.

(9) In some embodiments, in the burner assembly described in any one of (1) to (8), each of the burners includes a plurality of the support portions. The plurality of support portions are arranged around the fuel nozzle at intervals.

With the burner assembly described in (9), it is possible to ensure the stiffness of the burner while reducing the variation of the fuel concentration between the mixing passages.

(10) in some embodiments, in the burner assembly described in (9), each of the plurality of support portions is a swirl vane (e.g., the above-described swirl vane 56) configured to form an air flow in a common swirling direction.

With the burner assembly described in (10), the plurality of swirl vanes function as swirlers and can impart swirl to the air passing through the mixing passage. As a result, mixing of air and fuel in the mixing passage is promoted, and further reduction in NOx can be expected.

(11) A gas turbine combustor according to the present disclosure includes: the burner assembly described in any one of (1) to (10); and a combustion liner (e.g., the above-described combustion liner 25) forming a space in which a flame is formed downstream of the burner assembly, With the gas turbine combustor described in (11), since the gas turbine combustor includes the burner assembly described in any one of (1) to (10), it is possible to reduce NOx and suppress flashback, so that it is possible to stably use the combustor excellent in environmental performance.

(12) A gas turbine (e.g., the above-described gas turbine 100) according to the present disclosure includes: a compressor (e.g., the above-described compressor 2); a gas turbine combustor (e.g., the above-described combustor 4)

configured to be supplied with air compressed by the compressor and fuel, and produce a combustion gas by combusting the fuel; and a turbine (e.g., the above-described turbine 6) driven by the combustion gas produced by the gas turbine combustor. The gas turbine combustor is the gas turbine combustor described in (11).

With the gas turbine described in (12), since the gas turbine includes the gas turbine combustor described in (11), it is possible to stably operate the gas turbine excellent environmental performance.

REFERENCE SIGNS LIST

2 Compressor
4 Combustor
6 Turbine
8 Rotor
10 Compressor casing
12 Inlet
14 Inlet guide vane
16, 24 Stator vane
18, 26 Rotor blade
20 Casing
21 Bottom surface
22 Turbine casing
23 Gap
25 Combustion liner
28 Exhaust casing
30 Exhaust chamber
32 Burner assembly
34 Cylindrical member
35, 39, 84 Support portion
36 Air passage
40 Casing
42 Burner
43 Fuel nozzle
45, 48 Fuel passage
46 Mixing passage
50, 60 Surface
51 Fuel chamber
52 Convex curved surface
53 Fuel injection hole
55 Passage wall
56 Swirl vane
57 Outer surface
57*a* Upper surface
57*b* Lower surface
62 First surface
63 Wall surface
64 Stepped surface
66 Second surface
68 Outer peripheral surface
70 Constant outer diameter portion
72 Tapered portion
74, 78 Constant passage width portion
76 Contraction portion
80, 82 Upstream end portion
100 Gas turbine

The invention claimed is:

1. A burner assembly comprising a plurality of burners for mixing fuel and air, wherein each of the plurality of burners includes:

a fuel nozzle for injecting the fuel;

a mixing passage supplied with the fuel and the air;

a support portion connecting a passage wall of the mixing passage and the fuel nozzle to support the fuel nozzle;

a first passage formed inside the fuel nozzle and extending along an axial direction of the fuel nozzle;

a fuel chamber formed outside of the mixing passage in a radial direction of the fuel nozzle and holding the fuel to be supplied to the fuel nozzle; and a second fuel passage formed inside the support portion, wherein one end of the second fuel passage is connected to the first fuel passage, and the other end of the second fuel passage is connected to the fuel chamber.

2. The burner assembly according to claim 1, wherein the fuel nozzle includes a tapered portion whose outer diameter decreases downstream in a flow direction of the air, wherein the mixing passage includes a contraction portion whose passage width decreases downstream in the flow direction of the air, and wherein a range where the tapered portion is disposed and a range where the contraction portion is disposed at least partially overlap in an axial direction of the mixing passage.

3. The burner assembly according to claim 1, wherein a fuel passage for supplying the fuel to the fuel nozzle is formed inside the support portion.

4. The burner assembly according to claim 3, wherein the support portion is formed inside the mixing passage.

5. The burner assembly according to claim 3, wherein the support portion is disposed upstream of the mixing passage in a flow direction of the air.

6. The burner assembly according to claim 5, wherein an upstream end portion of the fuel nozzle in the flow direction of the air is located outside the mixing passage, and wherein the support portion extends away from a fuel injection hole of the fuel nozzle in an axial direction of the mixing passage as the support portion comes close to the fuel nozzle.

7. The burner assembly according to claim 1, wherein an upstream surface of the support portion in a flow direction of the air includes a convex curved surface.

8. The burner assembly according to claim 1, wherein a downstream surface of the support portion in a flow direction of the air includes a stepped surface.

9. The burner assembly according to claim 1, wherein each of the burners includes a plurality of the support portions, and wherein the plurality of support portions are arranged around the fuel nozzle at intervals.

10. The burner assembly according to claim 9, wherein each of the plurality of support portions is a swirl vane configured to form an air flow in a common swirling direction.

11. A gas turbine combustor, comprising:

the burner assembly according to claim 1; and a combustion liner forming a space in which a flame is formed downstream of the burner assembly.

12. A gas turbine, comprising:

a compressor;

a gas turbine combustor configured to be supplied with air compressed by the compressor and fuel, and produce a combustion gas by combusting the fuel; and a turbine driven by the combustion gas produced by the gas turbine combustor, wherein the gas turbine combustor is the gas turbine combustor according to claim 11.

13. The burner assembly according to claim 1, wherein the burner assembly comprises a partition wall separating two adjacent mixing passages of the plurality of burners, wherein the fuel chamber is formed inside the partition wall.

* * * * *